US006149086A

United States Patent [19]

Young et al.

[11] Patent Number: 6,149,086

[45] Date of Patent: Nov. 21, 2000

[54] SHOE MOUNTING BRACKET FOR A VERTICAL SHAFT IMPACT CRUSHER AND LINER FOR SAME

[75] Inventors: Gregory A. Young, Cedar Rapids; Mike Stemper; Albert D. Botton, both of Marion, all of Iowa

[73] Assignee: Cedarapids, Inc., Cedar Rapids, Iowa

[21] Appl. No.: 09/273,790

[22] Filed: Mar. 22, 1999

[51] Int. Cl.[7] ..... B02C 19/00

[52] U.S. Cl. ..... 241/275

[58] Field of Search ..... 241/275, 300

[56] References Cited

U.S. PATENT DOCUMENTS

| | | | |
|---|---|---|---|
| 4,090,673 | 5/1978 | Ackers et al. . | |
| 4,577,806 | 3/1986 | Terrenzio | 241/275 |
| 4,699,326 | 10/1987 | Warren . | |
| 4,896,838 | 1/1990 | Vendelin et al. . | |
| 4,923,131 | 5/1990 | Rossouw et al. | 241/275 |
| 4,940,188 | 7/1990 | Rodriguez et al. | 241/275 |
| 5,323,974 | 6/1994 | Watajima . | |
| 5,497,951 | 3/1996 | Watajima . | |
| 5,639,030 | 6/1997 | Watajima et al. . | |

*Primary Examiner*—Mark Rosenbaum

*Attorney, Agent, or Firm*—Marshall, O'Toole, Gerstein, Murray & Borun

[57] ABSTRACT

An improved vertical shaft impact crusher, and in particular a crusher having a shoe assembly attached to a rotatable table assembly, the shoe assembly comprising a bracket, a shoe, and mounting bolts for removably attaching the shoe to the bracket. The shoe has a contact surface which engages a support surface of the bracket to reduce shear forces in the mounting bolts during rotation of the table assembly. The crusher also has a liner for protecting an outside face of the bracket. The liner has spacers located on a mounting surface which create a gap between the liner and the bracket, thereby reducing a prying action caused by uneven deflections in the mounting bracket during rotation of the table assembly.

13 Claims, 6 Drawing Sheets

SHOE MOUNTING BRACKET FOR A VERTICAL SHAFT IMPACT CRUSHER AND LINER FOR SAME

FIELD OF THE INVENTION

The present invention relates to rock crushing apparatus, and more particularly to vertical shaft impact crushers.

BACKGROUND OF THE INVENTION

Vertical shaft impact crushers are generally known in which centrifugal force is used to hurl large rocks against an impact surface, thereby to obtain smaller crushed rocks. Rock material is typically fed into a rotating impeller which hurls the rock material against a plurality of anvils disposed about the impeller. In the alternative, the rotating impeller throws the rock material against a bed of already crushed rock instead of the anvils. In either event, the rock crusher processes relatively larger rock material into relatively smaller crushed rock.

One important consideration in the design of rock crushers is the extension of the useful life span of the equipment. It will be appreciated that certain of the components come into direct contact with the rock material and therefore are subject to wear. The wear components are typically releasably attached to the rock crushing apparatus so that they may be removed and replaced. Other components are intended to be permanent, and therefore must be protected from direct contact with the rock material. The non-wear components are usually more permanently attached to the crusher apparatus.

For example, in a vertical shaft impact crusher of the "open table" type, the rotating impeller comprises a generally flat table having multiple shoe assemblies projecting from a top surface of the table near its periphery. The shoe assemblies typically comprise a support bracket attached to the table and a shoe releasably secured to the bracket. Rock material is dropped near the center of the table and, under centrifugal force, moves toward the periphery of the table where the shoes direct the large rock material toward an impact surface surrounding the table assembly, typically an anvil ring. The table is mounted on a flywheel attached to a rotating shaft. In this example, the shoes and anvil ring contact the rock material and therefore are wear components which should be attached to the crusher apparatus in such a manner that they are easily removed and replaced. The table, flywheel, and shaft are shielded from direct impact and therefore are more permanent, non-wear components.

Conventional rock crushers often use fasteners, such as bolts, to attach the shoe to support bracket. In such an arrangement, bolt holes extend through the bracket and corresponding threaded holes are formed in the shoe. The bolt holes and threaded holes have substantially the same size and are aligned so that bolts inserted therethrough releasably secure the shoe to the bracket. It will be appreciated that as the shoe assemblies are rotated by the table, a significant shear force develops between the fixed bracket and removable shoe. The shear force is quite large, particularly for heavier shoes, and therefore a significant risk exists that the bolts will be sheared and the shoes thrown.

In addition, conventional vertical shaft impact crushers often have a liner to protect the bracket from rock material bouncing off of the anvil ring. The liner is typically bolted in place and covers an outside face of the bracket. As the table spins, the centrifugal force acting on the shoe and bracket cause deflections in the bracket which increase in magnitude proportional to the height of the bracket above the upper surface of the table. The uneven deflections across the height of the bracket act to pry the bottom of the liner away from the bracket, thereby breaking the bolts from the bracket.

The present invention is provided to reduce the shear forces between the bracket and the shoe and/or to reduce prying forces between the bracket and the liner.

SUMMARY OF THE INVENTION

In accordance with one aspect of the present invention, a shoe assembly is provided in a vertical shaft impact crusher having a table assembly mounted for rotation about a central axis. The shoe assembly comprises a shoe having a front guide surface, a rear attachment surface, a contact surface extending transversely of the central axis, and a threaded aperture formed in the attachment surface. The shoe assembly further comprises a bracket having a front face, a rear face, an opening extending through the bracket from the front face to the rear face, and a support surface extending transversely of the central axis. A bolt is inserted through the opening and threaded into the threaded aperture to thereby releasably secure the shoe to the bracket. The support surface is disposed radially outwardly of the contact surface so that the contact surface of the shoe engages the support surface of the bracket when the table assembly is rotated.

The shoe may have a boss projecting rearwardly from the attachment surface so that an outer wall of the boss forms the contact surface. The bracket may have a recessed pocket formed in the front face sized to accept the boss, an outer wall of the pocket forming the support surface. In addition, the opening in the bracket may be formed as a horizontally extending slot to ensure that the contact surface engages the support surface.

In accordance with another aspect of the present invention, a liner is provided in a vertical shaft impact crusher having a table rotating about a central axis and a bracket attached to an upper surface of the table, the bracket having an outside face. The liner has a shielding surface and a mounting surface, the shielding surface being sized to substantially cover the outside face of the bracket, and the mounting surface adapted for releasable attachment to the outside face of the bracket. A spacer projects from the mounting surface to thereby form a gap between the mounting surface of the liner and the outside face of the bracket.

BRIEF DESCRIPTION OF THE DRAWINGS

5

DESCRIPTION OF THE PREFERRED EMBODIMENTS

Figure 1:
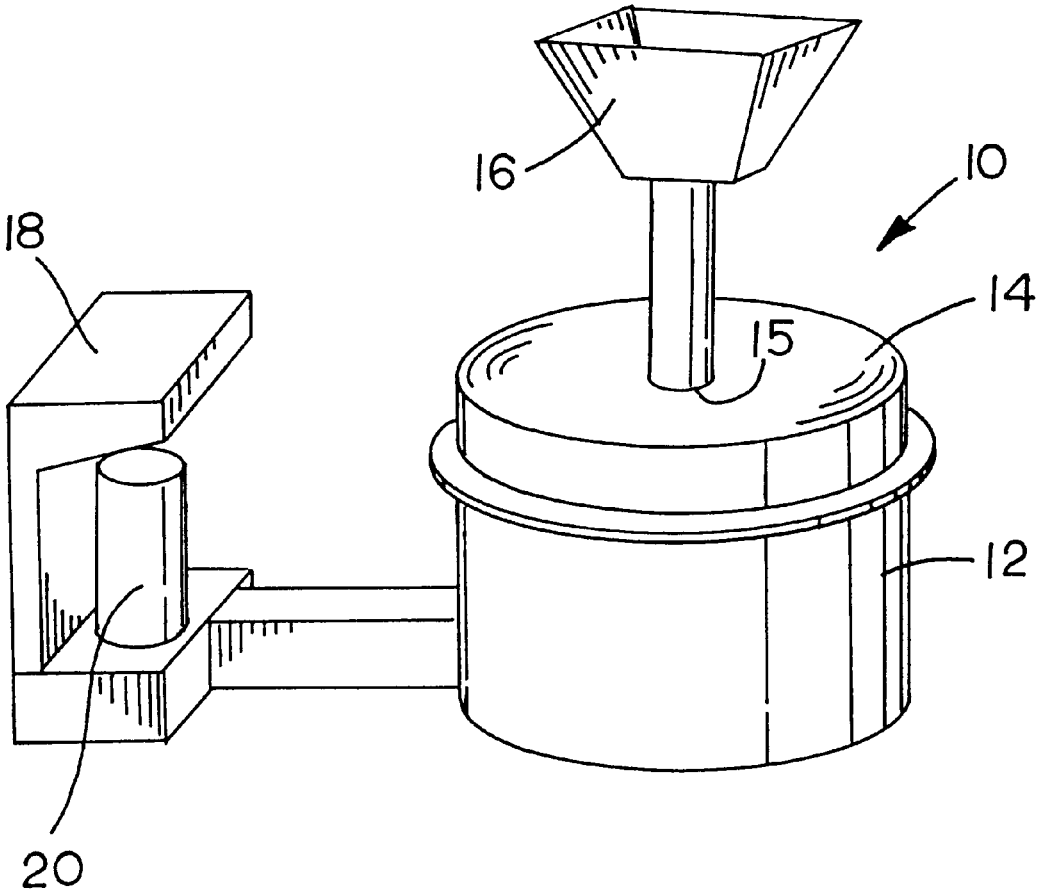
FIG. 1 is a schematic view in perspective of a vertical shaft impact crusher in accordance with the present invention.
Figure 2:
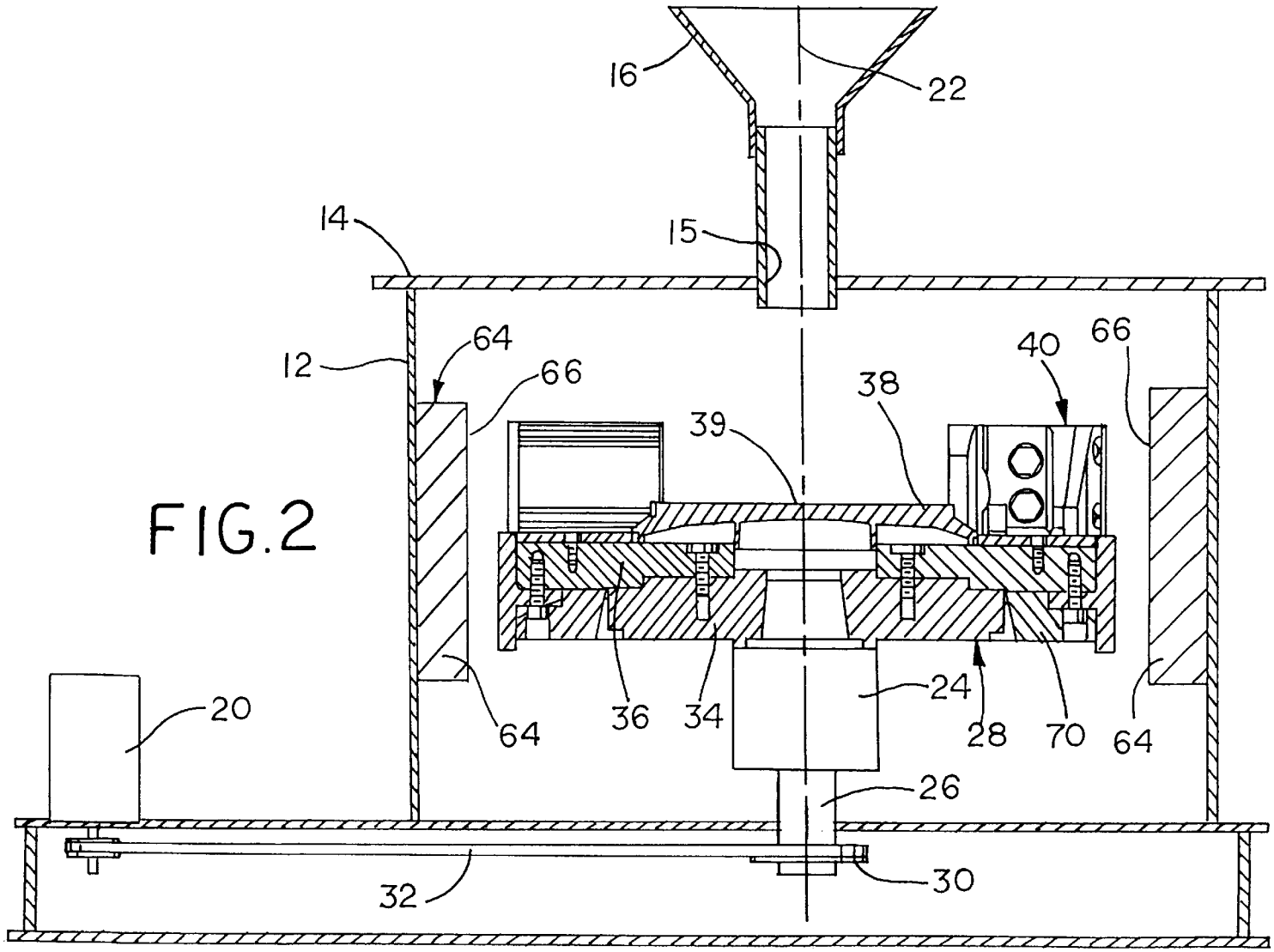
FIG. 2 is a side elevation view, in section, of a vertical shaft impact crusher in accordance with the present invention.

Referring initially to FIG. 1, a vertical shaft impact crusher of the present invention, indicated generally at 10, has a housing 12 with a housing cover 14 attached thereto. The housing cover 14 defines a feed opening 15, and a hopper 16 is attached to the housing cover 14 at the feed opening 15. A separate motor housing 18 is spaced from the housing 12 and houses a motor 20. As best illustrated in FIGS. 1 and 2, the housing 12 is generally cylindrical and has a central axis 22 extending vertically. A bearing assembly 24 is locating inside the housing 12, the bearing assembly rotatably journaling a shaft 26 having a table assembly 28 attached to an upper end. The lower end of the shaft 26 carries a pulley 30 which is driven by the motor 20 through a belt 32.

The table assembly 28 comprises a flywheel 34, a table 36, and a table cover 38. According to the illustrated embodiment, the table 36 is bolted to the flywheel 34 while the table cover 38 is attached to an upper surface of the table 36. A center portion of the table cover 38 provides a landing surface 39 onto which rock material entering the crusher 10 is deposited. The flywheel 34 engages the shaft 26 so that the entire table assembly 28 rotates with the shaft. The table assembly 28 may further comprise a reinforcing ring 70 attached to a bottom surface of the table 36. The reinforcing ring 70 may be adapted to allow a rim liner 76 to be attached to the table assembly 28 to thereby protect an outer edge 37 of the table 36 from the crushing impact inside the crusher 10.

Figure 3:
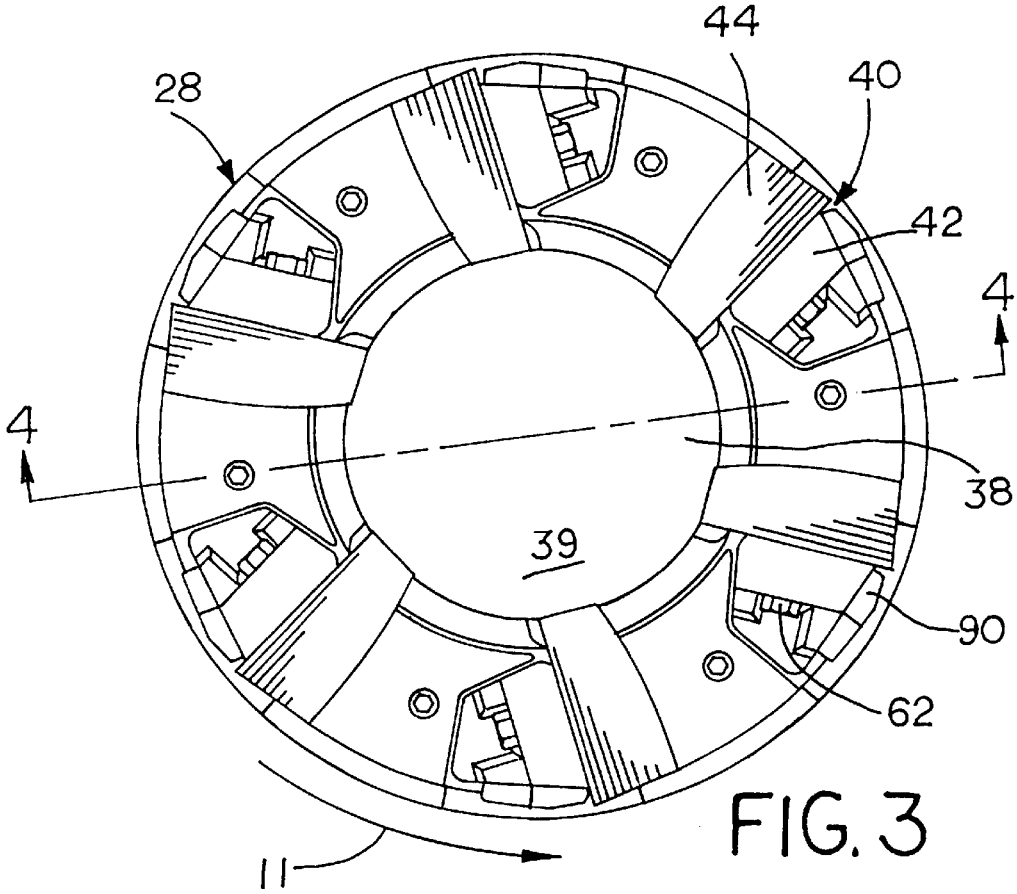
FIG. 3 is a top plan view of the table assembly of the present invention.
Figure 5:
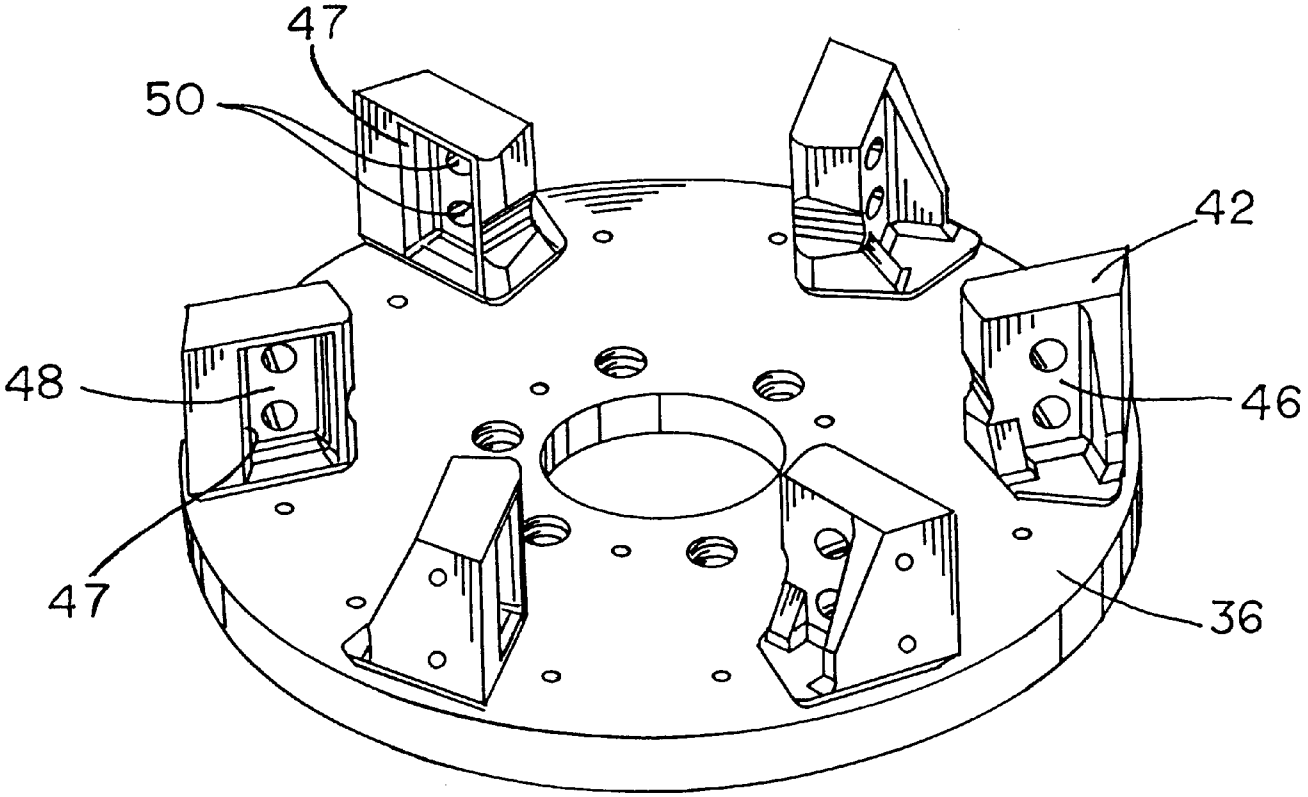
FIG. 5 is a perspective view of a table in accordance with the present invention having a plurality of brackets attached thereto.
Figure 6:
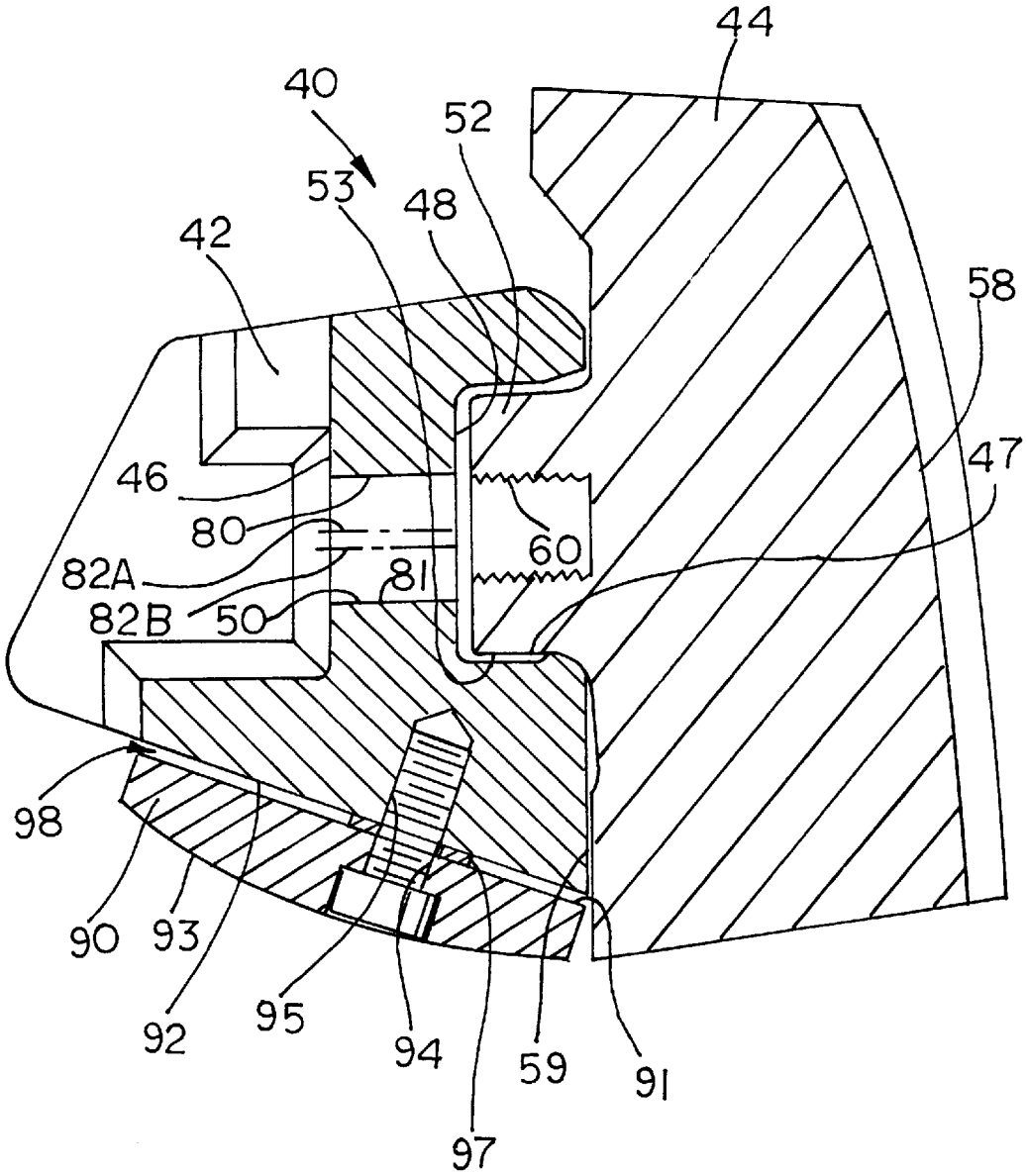
FIG. 6 is a top plan view, in section, taken along line 6—6 of FIG. 4 of a shoe assembly of the present invention including a liner.

At least one shoe assembly 40 is attached to an upper surface of the table assembly 28. As shown in FIGS. 3 and 6, each shoe assembly 40 comprises a bracket 42 and a removable shoe 44. In the currently preferred embodiment, each bracket 42 is welded to the table assembly 28 near a periphery of the table 36 (FIG. 5). Each bracket 42 is formed with a recess 46 located generally in a rear face of the bracket and a pocket 48 located in a front face of the bracket. A pair of openings 50 extend through the bracket 42 from the recess 46 to the pocket 48. As best shown in FIG. 6, the pocket 48 has a support surface 47 extending transversely of the central axis 22.

Figure 4:
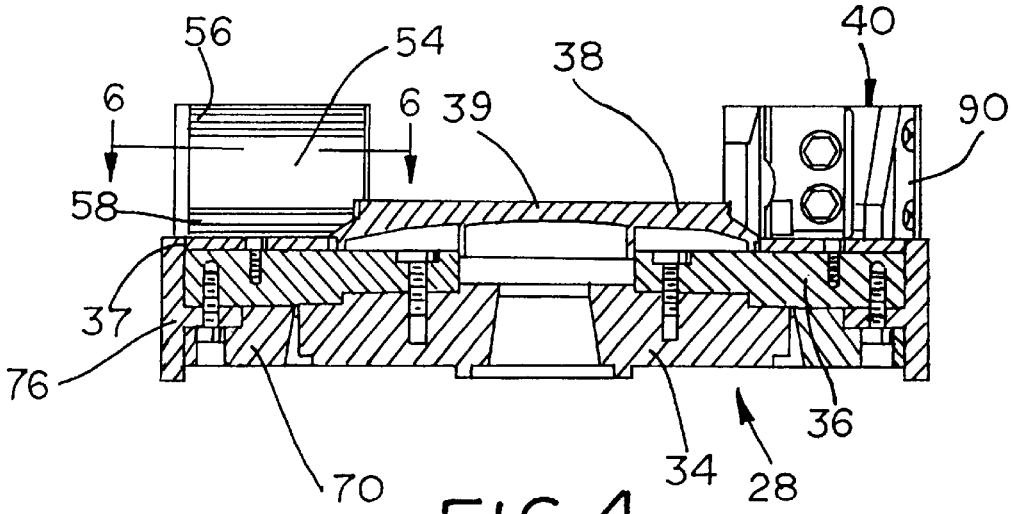
FIG. 4 is a side elevational view, in section, of the table assembly taken along line 4—4 of FIG. 3.

Each shoe 44 is formed to be releasably attached to a corresponding bracket 42. The shoe 44 has a front guide surface 54 and a rear attachment surface 59. The guide surface 54 is curved and extends generally radially from the central axis 22. The guide surface 54 has forward projecting upper and lower edges 56, 58 (FIG. 4). A boss 52 projects from the rear attachment surface 59 of each shoe 44 and is shaped to slidably fit inside the pocket 48 formed in the bracket 42. A pair of threaded apertures 60 are formed in the boss 52 and are positioned so that they are aligned with the bolt holes 50 when the boss 52 is inserted in the pocket 48, as illustrated in FIG. 6. A pair of bolts 62 (FIG. 3) are inserted through the bolt holes 50 and into the threaded holes 60 to thereby releasably secure the shoe 44 to the corresponding bracket 42. An outside edge of the boss 52 forms a contact surface 53 extending transversely of the central axis 22 for engaging the support surface 47 of the bracket 42, as described in greater detail below.

An anvil ring 64 is located around a periphery of the housing 12 for providing an impact surface 66 for breaking incoming rock material (FIG. 2). According to the illustrated embodiment, the anvil ring 64 comprises a plurality of individual anvils 64 spaced about the interior of the housing 12. While the illustrated embodiment shows an anvil ring 64, it will be appreciated that the impact surface 66 may be provided by other structure, such as previously broken rock material accumulating on a rock shelf. Crushed rock collects in a bottom portion of the housing 12 where a removal device (not shown) carries the crushed rock out of the crusher 10.

In operation, rock material is dumped into the hopper 16 where it passes through the feed opening 15 to be deposited on the landing surface 39 of the table assembly 28. In the illustrated embodiment, the motor 20 drives the shaft 26 so that the attached table assembly 28 rotates in a counterclockwise direction indicated by arrow 11 in FIG. 3. As a result, rock material deposited on the Landing surface 39 is driven radially outwardly from the center of the table assembly 28 by centrifugal force. The guide surfaces 54 of the shoes 44 define travel paths through which the rock material is directed. The guide surfaces 54 direct the rock material toward the anvil ring 64 at an angle which optimizes breakage. The broken rock material collects at the bottom of the housing 12 where it is removed.

In accordance with certain aspects of the present invention, the centrifugal force acting to throw the shoe radially outwardly is resisted by the bracket 42, thereby reducing shear forces acting on the mounting bolts 62. The openings 50 in the bracket 42 are aligned with the threaded apertures 60 such that the contact surface 53 engages the support surface 47 as the table assembly 28 rotates. In the currently preferred embodiment, the openings 50 are formed as horizontally extending slots. The slots have radiused inside and outside edges 80, 81 formed about centerlines 82*a* and 82*b*, respectively. Thus, the mounting bolts 62 extending through the slots, and the shoe 44 to which the bolts 62 are attached, are allowed to slide radially outward. Before the mounting bolts 62 contact the outside edges 81 of the slots, the contact surface 53 of the shoe 44 engages the support surface 47 of the bracket 42. As a result, the shear forces on the mounting bolts 62 are significantly reduced since the bracket structure 42, rather than the bolts 62, resists movement of the shoe 44 in the radially outward direction.

Figure 7:
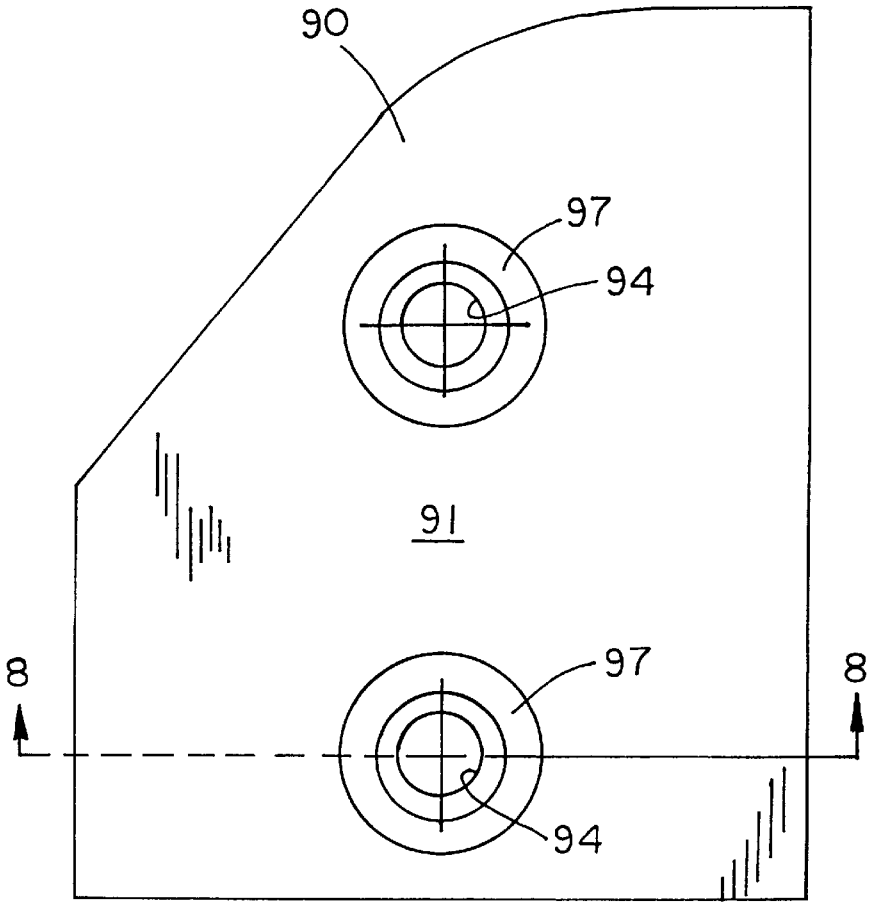
FIG. 7 is a side elevation view of a liner in accordance with the present invention.
Figure 8:
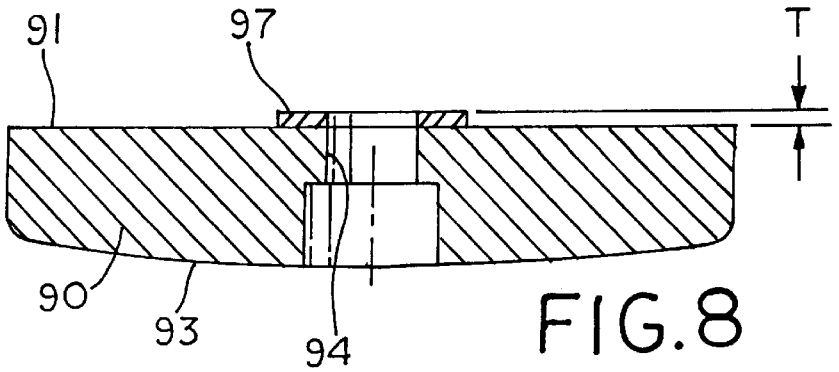
FIG. 8 is a plan view, in section, of the liner taken along line 8—8 of FIG. 7.

In accordance with additional aspects of the present invention, a liner 90 is attached to an outside face 92 (FIG. 6) of the bracket 42 to thereby protect the bracket 42 from rock material ricocheting off of the anvil ring 64. The liner 90 has a substantially planar rear mounting surface 91 and a curved front shielding surface 93 sized to substantially cover the outside face 92. As best illustrated in FIGS. 6–8, a pair of bolt holes 94 extend through the liner 90 from the front surface 93 to the rear surface 91 and threaded apertures 95 are formed in the outside face 92 of the bracket, so that the liner 90 may be releasably attached to the bracket 42 using bolts (not shown).

Spacers 97 are located on the mounting surface 91 of the liner 90, generally disposed around the each bolt hole 94. The spacers 97 may be formed integrally with the liner 90, such as by machining or casting, or may be provided as separate components which are permanently affixed to the liner 90, such as by welding. In the illustrated embodiment, the spacers 97 are annular washers welded to the mounting surface 91 of the liner 90. The spacers 97 have a thickness "T" (FIG. 8) which creates a gap 98 between the outside face 92 of the bracket 42 and the mounting surface 91 of the liner 90 when the liner 90 is attached to the bracket 42.

As noted above, deflections are greatest near the top of the bracket 42, and therefore the gap 98 is most preferably formed between the top portions of the liner 90 and bracket 42. In the illustrated embodiment, the gap 98 is formed substantially uniformly between the entire lengths of the liner 90 and bracket 42. Only the spacers 97 contact the bracket 42, and therefore the gap 98 allows the bracket 42 to deflect unevenly without creating a significant prying force against the liner 90.

The vertical shaft impact crusher of the present invention has significant advantages over prior crushers. By providing a shoe assembly in which a contact surface of the shoe engages a support surface of the bracket, the risk of shearing mounting bolts connecting the shoe to the bracket is reduced. In addition, the use of spacers on the mounting surface of a liner creates a gap between the liner and the bracket, thereby reducing the risk of prying the liner from the bracket due to uneven deflections in the bracket.

The foregoing detailed description has been given for clearness for understanding only, and no unnecessary limitations should be understood therefrom, as modifications would be obvious to those skilled in the art.

What is claimed is:

1. In a vertical shaft impact crusher having a table assembly mounted for rotation about a central axis, a shoe assembly comprising:

a shoe having a front guide surface, a rear attachment surface, a contact surface extending transversely of the central axis, and a threaded aperture formed in the attachment surface the threaded aperture having a diameter;

a bracket adapted for attachment to the table assembly having a front face, a rear face, an opening extending through the bracket from the front face to the rear face, and a support surface extending transversely of the central axis and facing the contact surface, the bracket opening having a width normal to the central axis which is greater than the threaded aperture diameter; and a bolt passing through the bracket opening and threaded into the threaded aperture of the shoe thereby to releasably secure the shoe to the bracket;

wherein the bracket opening allows the bolt and shoe to slide radially outwardly so that the contact surface of the shoe engages the support surface of the bracket when the table assembly is rotated.

2. The crusher of claim 1, in which the shoe has a boss projecting rearwardly from the attachment surface, the contact surface being formed by an outer wall of the boss.

3. The crusher of claim 2, in which the bracket has a recessed pocket formed in the front face, the support surface being formed by an outer wall of the pocket.

4. The crusher of claim 1, in which the central axis extends vertically and the opening in the bracket is formed as a horizontally extending slot.

5. The crusher of claim 4, wherein the slot is adapted so that as the support and contact surfaces engage contact between the bolt and the bracket is prevented.

6. A vertical shaft impact crusher comprising:

a table assembly mounted for rotation about a central axis;

a shoe bracket attached to an upper surface of the table assembly, the shoe bracket having an outside face extending transversely to the central axis; and a liner having a shielding surface facing away from the shoe bracket outside surface and sized to substantially overlie the outside face of the shoe bracket, a mounting surface substantially conforming to the shape of, and facing toward, the shoe bracket outside surface, and means for mounting the liner to the shoe bracket outside surface, the mounting means including a spacer disposed between the shoe bracket outside face and the liner mounting surface to form a gap therebetween.

7. The crusher of claim 6, in which the shoe bracket outside face further comprises a threaded aperture, the liner mounting means comprises a bolt hole extending from the shielding surface to the mounting surface and a bolt inserted through the bolt hole and into the threaded aperture thereby to releasably attach the liner to the bracket.

8. The crusher of claim 7, in which the spacer is disposed around the bolt hole.

9. The crusher of claim 6, in which the spacer is located near a top portion of the liner so that the gap is formed near at least a top edge of the bracket.

10. The crusher of claim 6 in which the spacer has an annular shape.

11. The crusher of claim 6 in which the spacer comprises a washer.

12. The crusher of claim 6 in which the spacer is formed integrally with the liner.

13. The crusher of claim 6 in which the spacer is formed separately from the liner, the spacer being permanently attached to the mounting surface.

* * * * *